US011795772B2

(12) United States Patent
Roselier et al.

(10) Patent No.: US 11,795,772 B2
(45) Date of Patent: Oct. 24, 2023

(54) EXTRUDABLE BALL SEAT SYSTEM AND METHODOLOGY

(71) Applicant: SALTEL INDUSTRIES SAS, Bruz (FR)

(72) Inventors: Samuel Roselier, Bruz (FR); Francois Bajart, Bruz (FR); Julie Leduc, Bruz (FR); Romain Neveu, Bruz (FR); Robin Limary, Bruz (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 193 days.

(21) Appl. No.: 17/423,336

(22) PCT Filed: Jan. 23, 2020

(86) PCT No.: PCT/EP2020/051616
§ 371 (c)(1),
(2) Date: Jul. 15, 2021

(87) PCT Pub. No.: WO2020/156921
PCT Pub. Date: Aug. 6, 2020

(65) Prior Publication Data

US 2022/0081984 A1 Mar. 17, 2022

(30) Foreign Application Priority Data

Jan. 28, 2019 (EP) ..... 19305105

(51) Int. Cl.
*E21B 23/04* (2006.01)
*E21B 34/14* (2006.01)

(52) U.S. Cl.
CPC ..... *E21B 23/0413* (2020.05); *E21B 34/142* (2020.05)

(58) Field of Classification Search
CPC ..... E21B 23/0413; E21B 34/142
See application file for complete search history.

(56) References Cited

U.S. PATENT DOCUMENTS 2,196,652 A * 4/1940 Baker ..... E21B 33/146 166/194
5,143,992 A 9/1992 Kelsey
(Continued)

FOREIGN PATENT DOCUMENTS

WO 9848143 A1 10/1998

OTHER PUBLICATIONS

International Search Report and Written Opinion issued in PCT Application PCT/EP2020/051616, dated Mar. 23, 2020 (15 pages).

*Primary Examiner* — Robert E Fuller
*Assistant Examiner* — Neel Girish Patel
(74) *Attorney, Agent, or Firm* — Michael Wills, III

(57) ABSTRACT

An extrudable ball seat (36) is configured to be secured along a well tubing (34). The extrudable ball seat (36) comprises a larger diameter section (42) and a smaller diameter (44) section connected by a conical section (46). The conical section (46) has an internal seating surface (48) for receiving a corresponding element, e.g. a ball (52), in sealing engagement. The extrudable ball seat (36) facilitates controlled extrusion of the element following a pressure actuation procedure by providing the smaller diameter section (44) with sufficient ductility to enable extrusion of the element under an increased predetermined pressure. Additionally, the extrudable ball seat comprises at least one notch (56), e.g. a plurality of grooves (58), positioned to initiate crack propagation and thus extrusion of larger elements.

18 Claims, 13 Drawing Sheets

(56) References Cited

U.S. PATENT DOCUMENTS

| | | | | |
|---|---|---|---|---|
| 5,146,992 | A | 9/1992 | Baugh | |
| 5,960,881 | A * | 10/1999 | Allamon | E21B 34/14 166/70 |
| 6,739,398 | B1 * | 5/2004 | Yokley | E21B 23/04 166/123 |
| 7,469,744 | B2 | 12/2008 | Ruddock et al. | |
| 2008/0048443 | A1 * | 2/2008 | Paton | F16J 15/0806 285/333 |
| 2013/0081817 | A1 | 4/2013 | Norrid et al. | |
| 2014/0060813 | A1 | 3/2014 | Naedler et al. | |
| 2015/0075818 | A1 * | 3/2015 | Roselier | E21B 17/07 166/387 |
| 2017/0122441 | A1 | 5/2017 | Adam | |
| 2018/0016867 | A1 * | 1/2018 | Caminari | E21B 34/06 |

* cited by examiner

EXTRUDABLE BALL SEAT SYSTEM AND METHODOLOGY

BACKGROUND

In many well applications, various types of tools are actuated hydraulically via pressure applied downhole. Some types of pressure actuation involve moving an element, e.g. a ball, downhole along the interior of well tubing and into sealed engagement with a corresponding seat. This allows pressure to be increased along the interior of the tubing for performing desired functions, such as actuation of a downhole device or conducting a cementing operation. In some applications, a ball is dropped and moved down through the well tubing into engagement with a corresponding ball seat. Once engaged, the pressure within the well tubing is increased to a predetermined pressure level sufficient to hydraulically actuate a downhole device, such as a liner hanger. The pressure may then be increased to a predetermined higher level sufficient to cause the ball and/or ball seat to break free and be discharged downhole.

SUMMARY

In general, a system and methodology are provided for utilizing an element, e.g. a ball, in a downhole pressure application. An extrudable ball seat is configured to be secured along a well tubing, e.g. along an interior of the well tubing. The extrudable ball seat comprises a larger diameter section and a smaller diameter section connected by a conical section. The conical section has an internal seating surface for receiving a corresponding element, e.g. a ball, in sealing engagement. The extrudable ball seat facilitates controlled extrusion of the element following the pressure application by providing the smaller diameter section with sufficient ductility to enable extrusion of the element under an increased predetermined pressure. Additionally, the extrudable ball seat comprises at least one notch, e.g. a plurality of grooves, positioned to initiate crack propagation and thus extrusion. The at least one notch enables the extrusion of elements, e.g. balls, having larger diameters and this allows more than one pressure actuation procedure to be performed using the same extrudable ball seat.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 2:
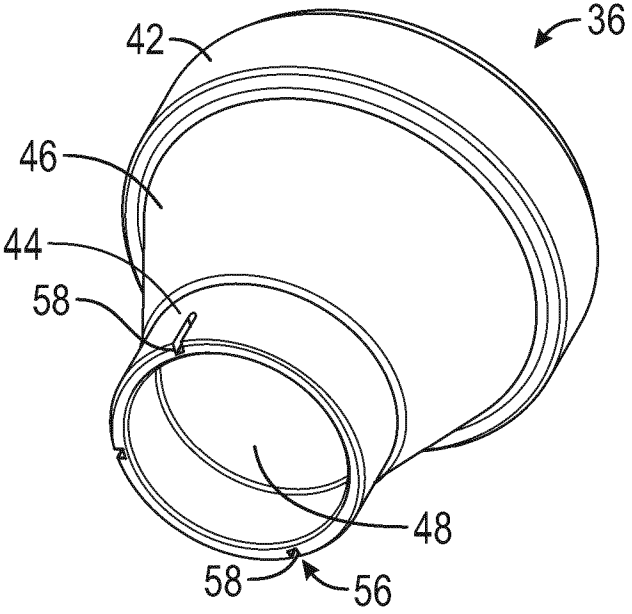
FIG. 2 is an orthogonal view of an example of the extrudable ball seat, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate use of an element, e.g. a ball, for building up pressure in a downhole application. In a variety of applications, a ball is dropped and moved downhole along the interior of well tubing until engaging an extrudable ball seat. The ball effectively seals against the extrudable ball seat which allows pressure to be increased in the well tubing for performance of a variety of functions, such as actuating a hydraulic tool. In some applications, the increased pressure may be used to hydraulically set a liner hanger, to release a liner hanger running tool, to facilitate a cementing operation, or to perform other actions downhole via pressure application.

The extrudable ball seat is configured to be secured along an interior of the well tubing. Depending on the application, the extrudable ball seat may be threadably engaged along the interior of the well tubing, latched into a corresponding notch in the well tubing, formed as part of a sub, e.g. housing, threadably engaged with corresponding joints of the well tubing, or otherwise secured at a desired position along the well tubing. The extrudable ball seat comprises a larger diameter section and a relatively smaller diameter section connected by a conical section. The conical section has an internal seating surface for receiving a corresponding element, e.g. a ball, in sealing engagement after the element is dropped into the well tubing and circulated downhole. It should be noted that "ball" refers to elements of a variety of shapes having a generally spherical or partially spherical engagement surface. The dropped element also may comprise darts or other types of elements which may be moved downhole along the well tubing for sealing engagement with the extrudable ball seat.

The extrudable ball seat facilitates controlled extrusion of the element following the pressure application by providing the smaller diameter section with sufficient ductility to enable extrusion of the element under an increased predetermined pressure. For example, once a pressure actuation operation is completed the pressure in the well tubing may be increased sufficiently to extrude the element through the extrudable ball seat. Additionally, the extrudable ball seat comprises at least one notch, e.g. a plurality of grooves, positioned to initiate crack propagation and thus a subsequent extrusion. The at least one notch enables the extrusion of elements, e.g. balls, having different diameters of at least a pre-set value. This allows more than one pressure actuation procedure to be performed using the same extrudable ball seat.

According to an embodiment, the extrudable ball seat may be formed of a sufficiently ductile material, such as a suitable steel or stainless steel. In some embodiments, the larger diameter section and smaller diameter section may be generally cylindrical. The at least one notch may be in the form of grooves machined in a generally axial direction along the smaller diameter section to facilitate generally longitudinal cracks. This enables a reduction in the extrusion pressure for extrusion of larger elements, e.g. larger balls. The size and ductility of the smaller diameter section and the conical section are selected so that cracks initiate at a pre-set value of element diameter. Balls or other elements having a diameter smaller than the pre-set diameter do not break/crack the extrudable ball seat.

In some applications, a polished bore receptacle may be placed adjacent the extrudable ball seat, e.g. above the extrudable ball seat, to receive certain types of larger elements, e.g. darts. Additionally, the construction of the extrudable ball seat facilitates extrusion of such larger elements following crack propagation. Crack propagation effectively enables passage of these larger elements through the extrudable ball seat using a reduced extrusion pressure.

Figure 1:
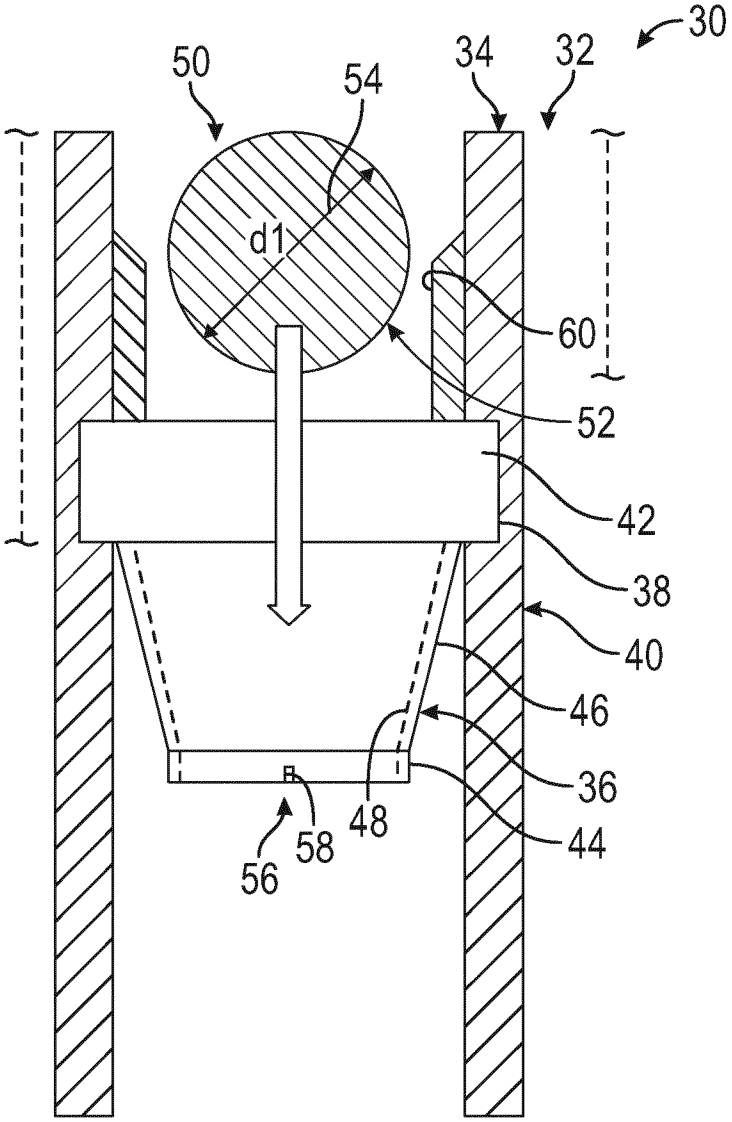
FIG. 1 is a schematic illustration of an example of an extrudable ball seat positioned in a well system located in a borehole, e.g. a wellbore, according to an embodiment of the disclosure.

Referring generally to FIG. 1, an example of a well system 30 is illustrated as deployed in a borehole 32, e.g. a wellbore. The well system 30 comprises a well tubing 34 deployed along the borehole 32. The well tubing 34 may be in the form of drill pipe, a tubular running string, or various other types of tubing employed for downhole applications. Additionally, the well system 30 comprises an extrudable ball seat 36 secured along an interior of the well tubing 34 via attachment features 38. By way of example, the attachment features 38 may comprise threads for threaded engagement along an interior of the well tubing 34, a latch mechanism which latches into a corresponding notch in the well tubing 34, or features for engagement with a corresponding housing 40 positioned along or within the well tubing 34. For example, the corresponding housing 40 may be formed as part of a sub threadably engaged with corresponding joints of the well tubing 34. However, the extrudable ball seat 36 may be positioned and secured along the well tubing 34 by various other types of suitable mechanisms.

In the illustrated example, the extrudable ball seat 36 comprises a larger diameter section 42, a smaller diameter section 44, and a conical section 46 extending between the larger diameter section 42 and the smaller diameter section 44. The conical section 46 has an internal, conical sealing surface 48, as further illustrated in FIG. 2. The internal surface 48 provides an internal seat surface, e.g. an internal ball seat surface, for receiving an element 50 in sealing engagement. In the illustrated example, the element 50 is in the form of a ball 52 having a diameter 54 sized to enable the ball 52 to seal against the internal surface 48 when ball 52 is landed in the extrudable ball seat 36 after being circulated downhole along the interior of well tubing 34.

The smaller diameter section 44 and conical section 46 may be formed of a material which expands sufficiently to extrude the ball 52 (having the predetermined diameter 54) when sufficient pressure is applied after ball 52 is seated against internal, conical sealing surface 48. For example, the smaller diameter section 44 and the conical section 46 may be formed of a suitable steel material, stainless steel material, or other material which has suitable ductility to expand sufficiently when ball 52 is extruded through the extrudable ball seat 36 under increased pressure. According to various embodiments, the entire extrudable ball seat 36 may be a one-piece element formed of a single plastically deformable material, e.g. steel or stainless steel. In some embodiments, the smaller diameter section 44 and/or the larger diameter section 42 may be formed generally as cylinders having cylindrical shapes extending in an axial direction along the well tubing 34/housing 40.

As illustrated in FIGS. 1 and 2, the extrudable ball seat 36 further comprises at least one notch 56 positioned to facilitate crack propagation through a desired region of the extrudable ball seat 36. For example, the at least one notch 56 may be located in the smaller diameter section 44. In some embodiments, the at least one notch 56 comprises a plurality of grooves 58 which are machined or otherwise formed in the smaller diameter section 44 or other suitable section of extrudable ball seat 36. In the illustrated example, grooves 58 are formed in a cylindrically shaped smaller diameter section 44 and oriented in a generally axial or longitudinal direction along the cylinder portion of the smaller diameter section 44.

As explained in greater detail below, when a second ball having a diameter of at least a pre-set value is extruded through the smaller diameter section 44, a crack or cracks propagate from the at least one notch 56 to enable passage of the second ball (or other suitable element). The second ball is generally larger than the first ball 52 and when the diameter of the second ball is of at least the pre-set value, the crack or cracks are initiated and propagate. The expandability of the smaller diameter section 44 combined with the at least one notch 56 enables the extrusion of elements, e.g. balls, having different diameters. This capability allows more than one pressure actuation procedure to be performed using the same extrudable ball seat 36.

In some applications, the well system 30 also may comprise a polished bore receptacle 60. By way of example, the polished bore receptacle 60 may be placed adjacent the extrudable ball seat 36, e.g. directly uphole of the extrudable ball seat 36. In these applications, the polished bore receptacle 60 facilitates extrusion of other elements, e.g. darts, through the extrudable ball seat 36 following crack propagation. For example, the polished bore receptacle 60 may be used to sealably receive large elements, e.g. darts, which are subsequently extruded through the cracked extrudable ball seat 36 with a reduced extrusion pressure.

Figure 3:
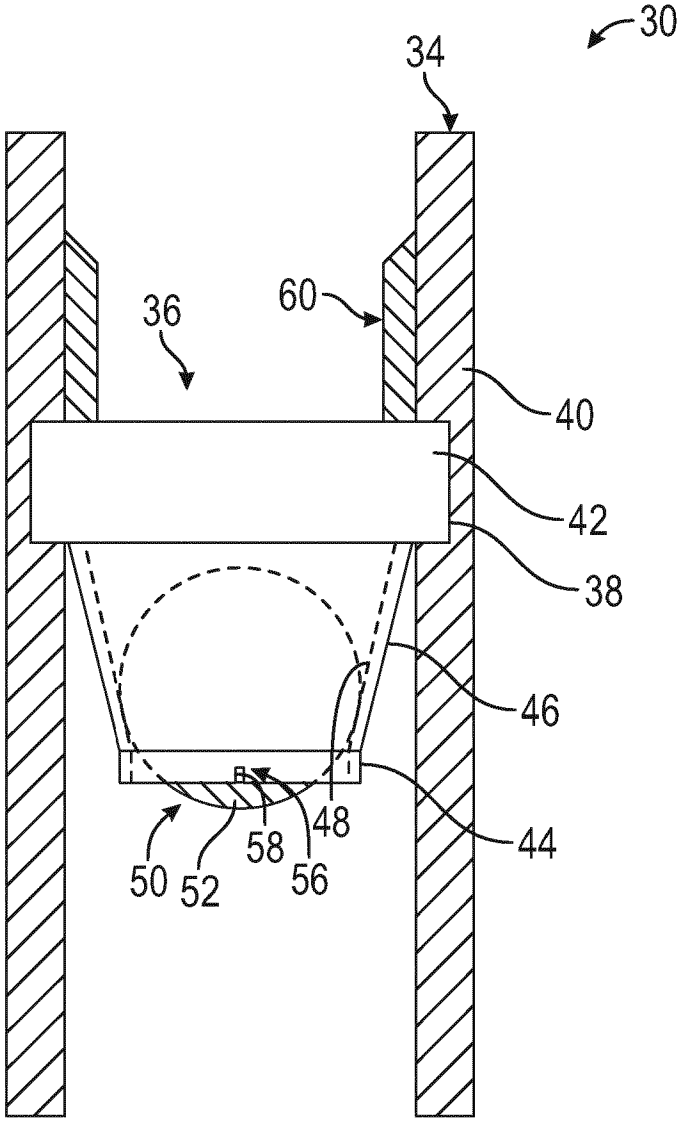
FIG. 3 is schematic illustration of the extrudable ball seat positioned downhole in the well system and in which a first ball has been landed, according to an embodiment of the disclosure.

According to an operational example, the first ball 52 is dropped into the well tubing 34 and circulated downhole until landed in the extrudable ball seat 36, as illustrated in FIG. 3. When landed, the ball 52 forms a seal with the internal sealing surface 48. In some embodiments, the extrudable ball seat 36 is formed of a suitable metal, e.g. steel, and the ball 52 also is formed of a metal material, e.g. steel, such that a metal-to-metal seal is created between the ball 52 and the internal seat surface 48. Once the seal is formed between ball 52 and internal surface 48, pressure may be increased in the well tubing 34 to a desired actuation level for performance of a variety of functions, such as actuating a hydraulic tool. In some applications, the actuation pressure may be used to hydraulically set a liner hanger, to release a liner hanger running tool, to facilitate a cementing operation, or to perform other actions downhole via pressure application.

Figure 4:
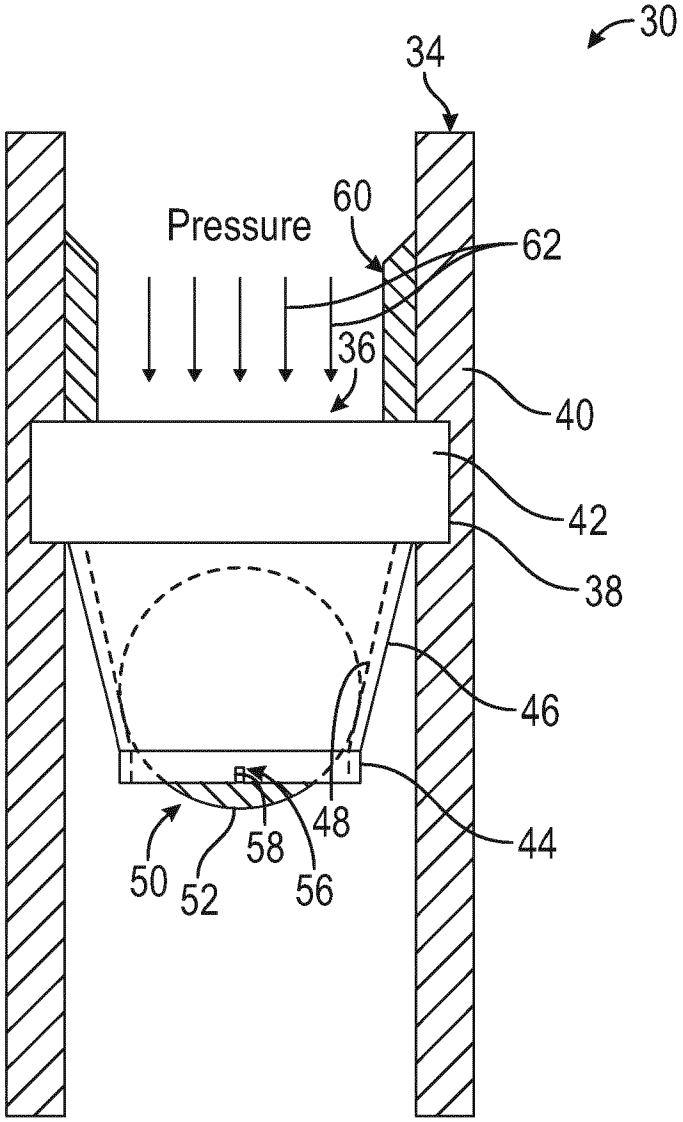
FIG. 4 is a schematic illustration similar to that of FIG. 3 showing pressure increased above the first ball, according to an embodiment of the disclosure.

Following the hydraulic actuation function, the pressure within well tubing 34 may be increased, as illustrated by arrows 62 in FIG. 4, to an extrusion level. The extrusion level pressure may be, for example, a predetermined pressure above 2000 psi, although other applications may use a predetermined extrusion level pressure above 3000 psi or above another selected pressure value applied within well tubing 34. The extrusion level pressure is used to extrude or expel the ball 52 through the extrudable ball seat 36.

Figure 5:
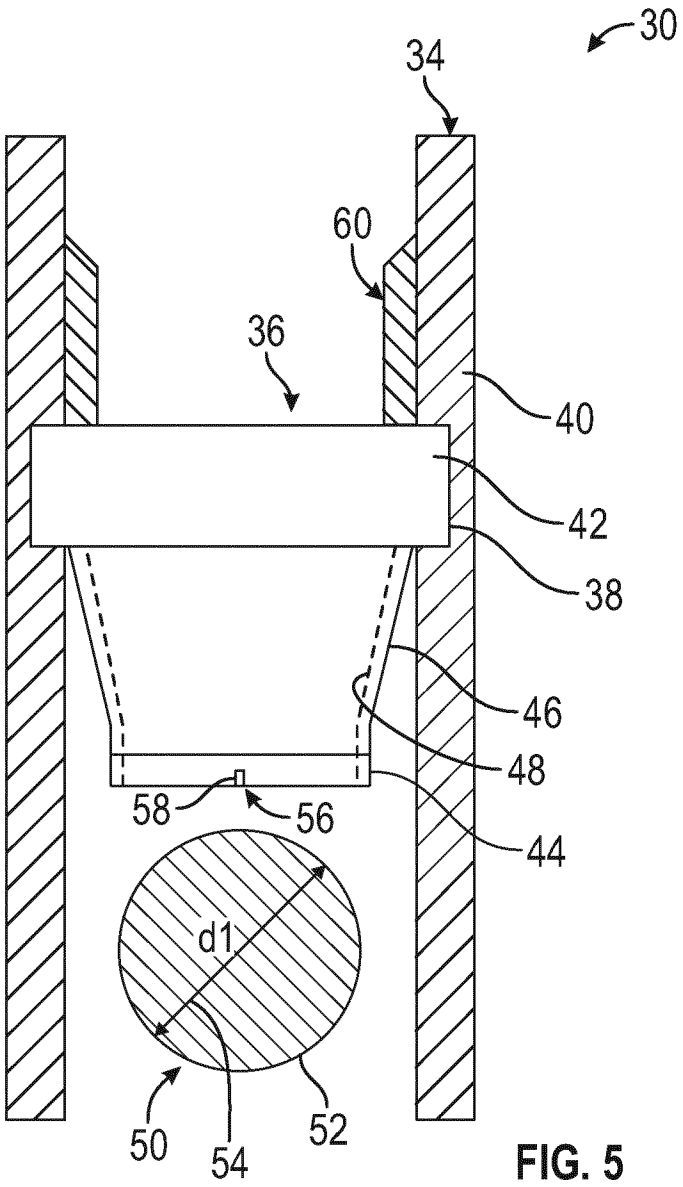
FIG. 5 is a schematic illustration similar to that of FIG. 4 but showing the first ball extruded following sufficient increase of pressure above the first ball to deform the extrudable ball seat and to expel the first ball, according to an embodiment of the disclosure.

For example, pressure may be increased above ball 52 to the extrusion level, thus deforming the ball seat 36 and sufficiently expanding the smaller diameter section 44 and conical section 46 to expel the ball 52, as illustrated in FIG. 5. In some embodiments, the extrudable ball seat 36 may be plastically deformed during extrusion of ball 52. However, the extrudable ball seat 36 is not broken, e.g. not cracked, during extrusion of ball 52. In other words, the diameter of ball 52 and the ductility of the material forming at least portions of extrudable ball seat 36, e.g. smaller diameter section 44, may be selected to enable extrusion of the ball 52 without cracks forming in the extrudable ball seat 36.

Figure 6:
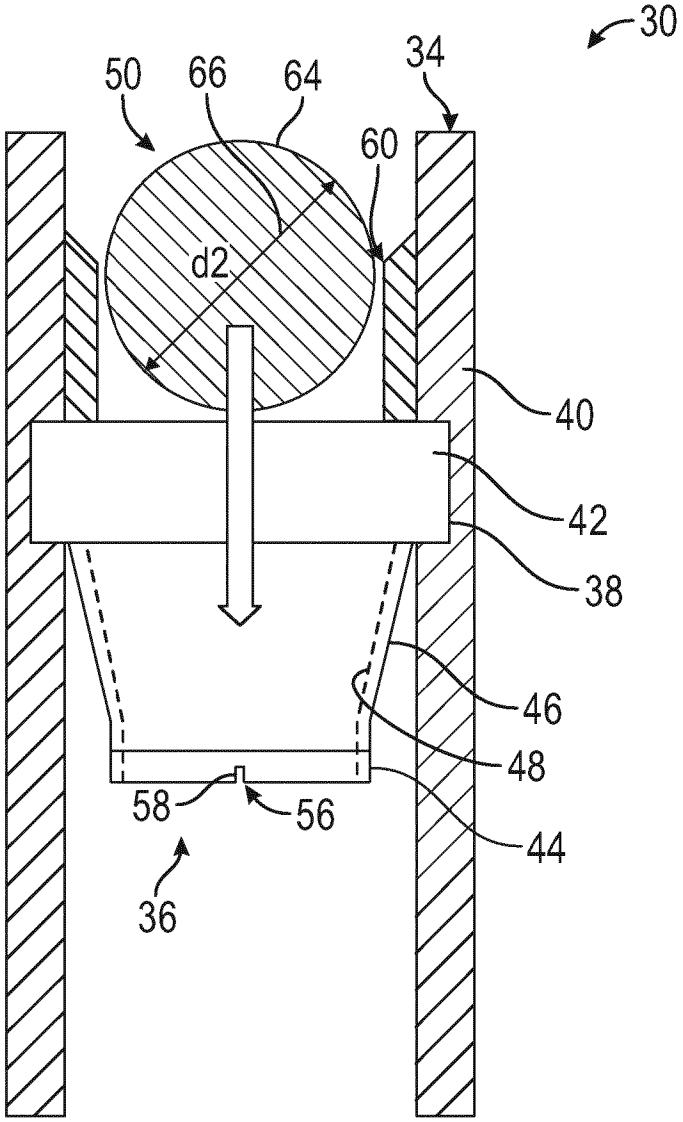
FIG. 6 is a schematic illustration of the extrudable ball seat receiving a second ball having a larger diameter than the first ball, according to an embodiment of the disclosure.
Figure 7:
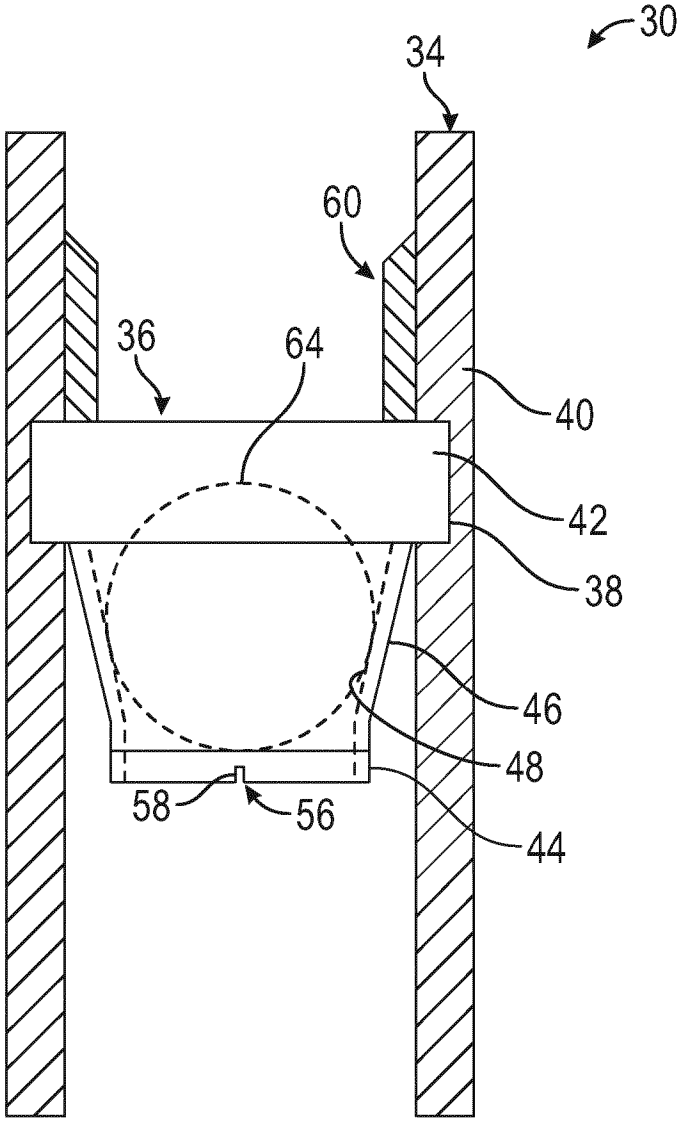
FIG. 7 is a schematic illustration similar to that of FIG. 6 but showing the second ball landed in the extrudable ball seat, according to an embodiment of the disclosure.

Subsequently, a second ball 64 is dropped into well tubing 34 and circulated downhole to the extrudable ball seat 36, as illustrated in FIG. 6. The second ball 64 has a predetermined diameter 66 which is larger than the diameter 54 of first ball 52. The second ball 64 is landed in the extrudable ball seat 36 such that a seal, e.g. a metal seal, is created between the second ball 64 and the internal seat surface 48, as illustrated in FIG. 7.

Once the seal is formed between ball 64 and internal surface 48, pressure may be increased in the well tubing 34 to a desired actuation level for performance of a variety of functions, such as actuating a hydraulic tool. In other words, a second hydraulic actuation function may be performed after extrusion of the first ball 52. As with the first actuation, the second application of actuation pressure may be used to hydraulically set a liner hanger, to release a liner hanger running tool, to facilitate a cementing operation, or to perform other actions downhole via pressure application.

Figure 8:
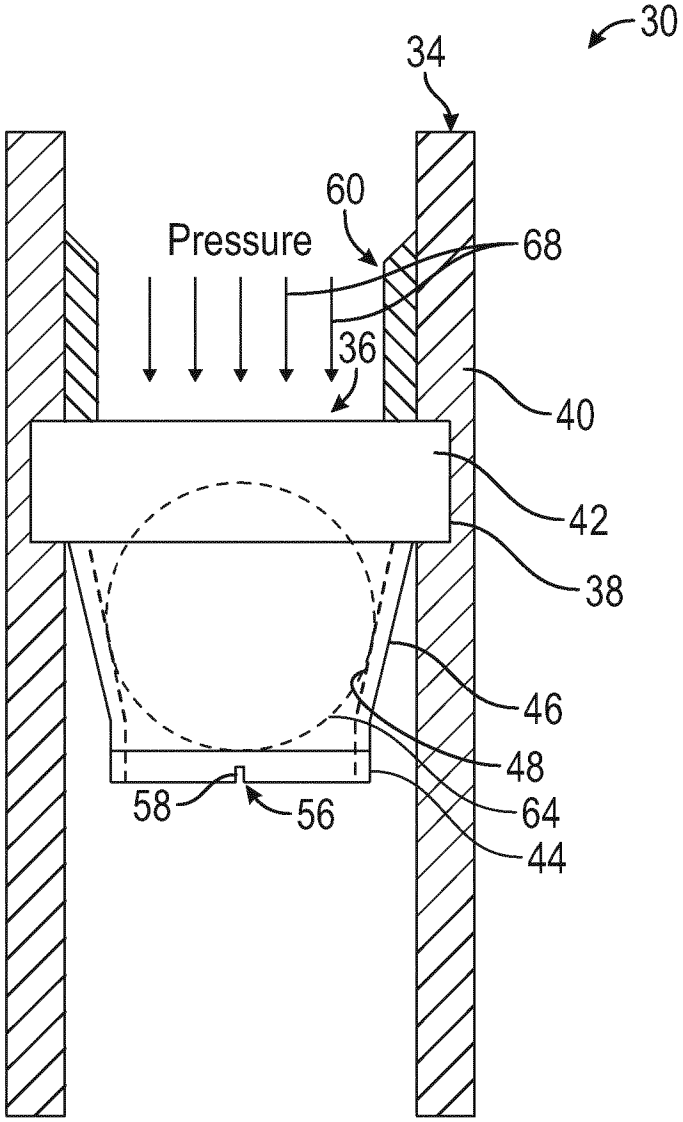
FIG. 8 is a schematic illustration similar to that of FIG. 7 showing pressure increased in the well tubing above the second ball, according to an embodiment of the disclosure.

Following the second hydraulic actuation function, the pressure within well tubing 34 may be increased, as illustrated by arrows 68 in FIG. 8, to a desired extrusion level. Depending on the application, the extrusion pressure 68 may be comparable to the extrusion pressure 60 described above or it may be a different level, e.g. a higher pressure value. The pressure 68 is increased above the ball 64 to expand the extrudable ball seat 36. If the diameter of second ball 64 is of at least a pre-set value, movement of the second ball 64 through extrudable ball seat 36 will initiate formation of a crack(s) 70 at the at least one notch 56, as illustrated in FIG. 9.

Figure 9:
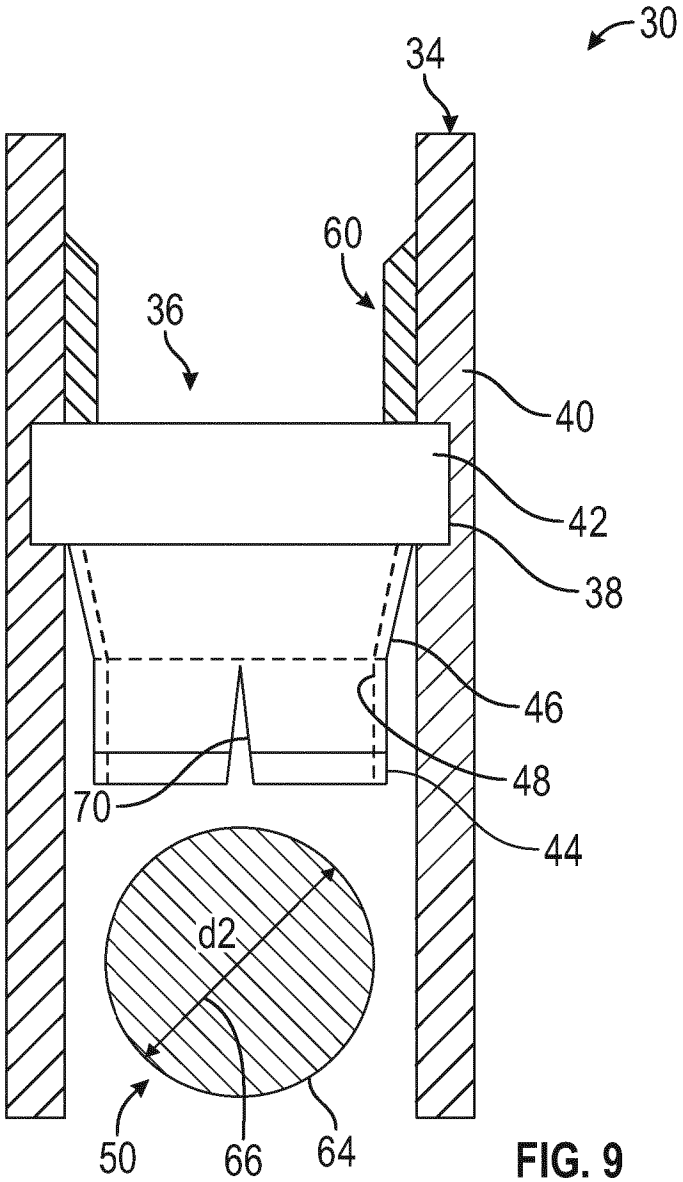
FIG. 9 is a schematic illustration similar to that of FIG. 8 but showing the second ball extruded following the sufficient increase of pressure above the second ball to plastically deform the extrudable ball seat and to initiate crack formation which facilitates expelling of the second ball, according to an embodiment of the disclosure.

For example, pressure may be increased above the second ball 64 to plastically deform the expandable ball seat 36; to initiate cracks 70; and to expel the ball 64 (see FIG. 9). The predetermined diameter of second ball 64 and the ductility of the material forming at least portions of extrudable ball seat 36 may be selected to enable formation of crack(s) 70 and thus extrusion of the ball 64. In some embodiments, the at least one notch 56 comprises the plurality of grooves 58 which are machined or otherwise formed in a given orientation and size to initiate a plurality of cracks at desired locations and in desired directions, e.g. in a longitudinal direction along the extrudable ball seat 36.

Figure 10:
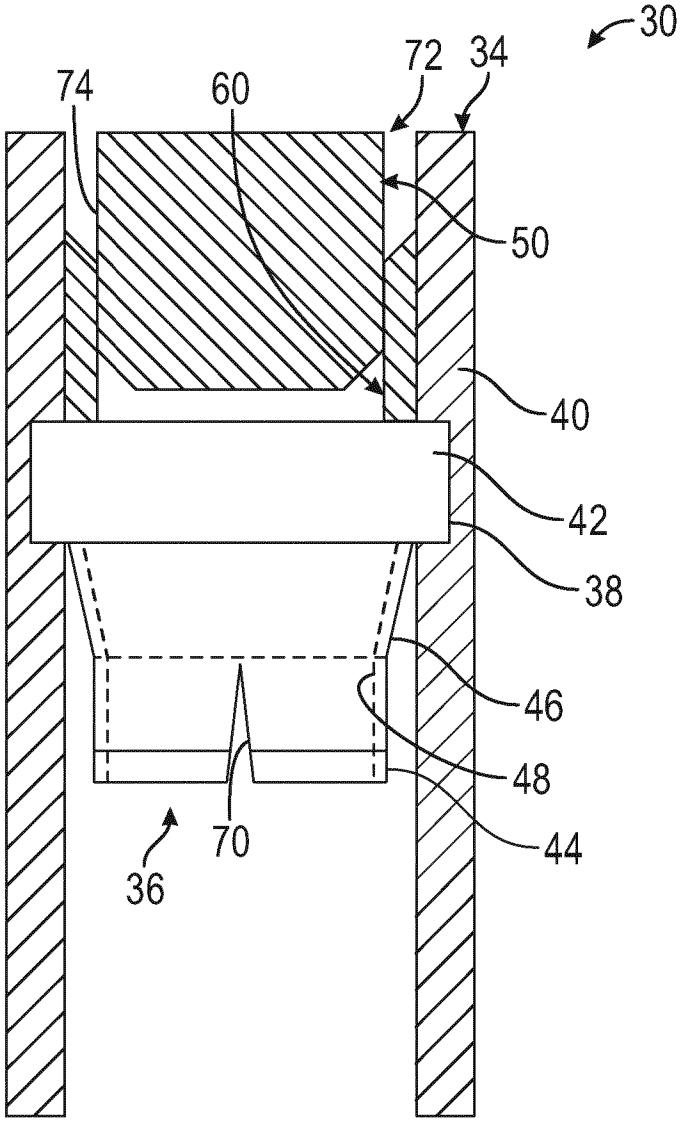
FIG. 10 a schematic illustration of the extrudable ball seat used in combination with another type of element, e.g. a dart, which has been dropped and moved downhole into engagement with a polished bore receptacle adjacent the extrudable ball seat, according to an embodiment of the disclosure.
Figure 11:
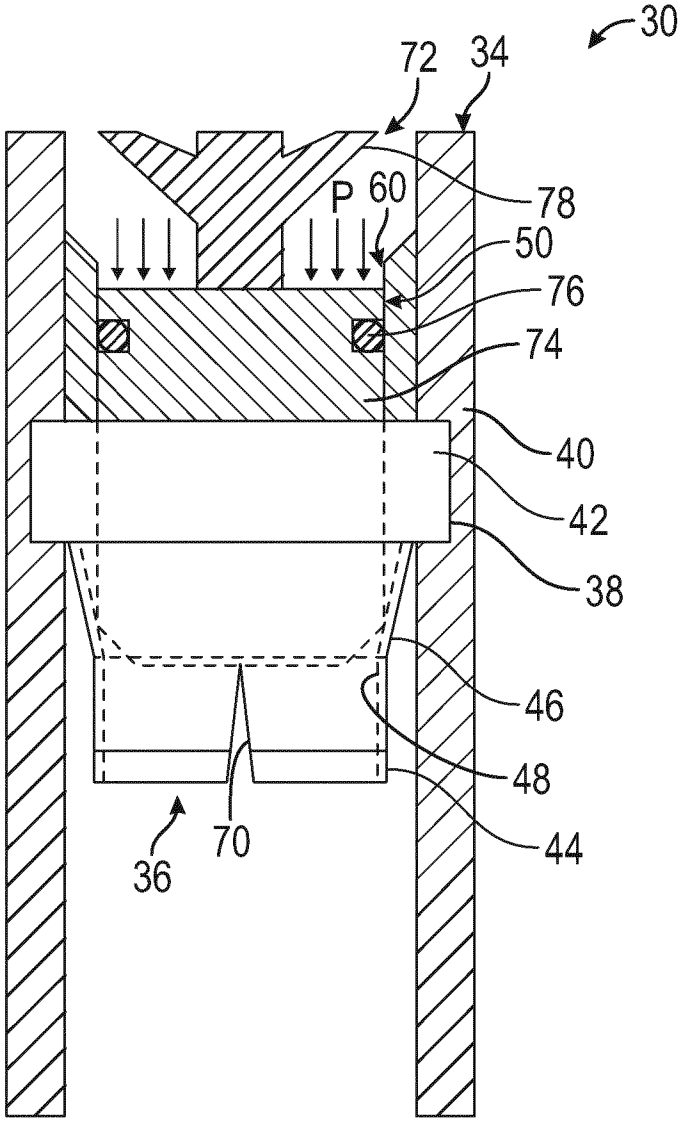
FIG. 11 is a schematic illustration similar to that of FIG. 10 but showing an increase of pressure above the element, according to an embodiment of the disclosure.

As further illustrated in FIG. 10, the element 50 may have other configurations, such as a dart 72. In this example, dart 72 is dropped from the surface and circulated down through well tubing 34 until a nose 74 of the dart 72 is received inside the polished bore receptacle 60. The dart 72 may comprise a seal or seals 76 positioned to cooperate with and seal against an interior surface of the polished bore receptacle 60, as illustrated in FIG. 11. Additionally, the dart 72 may comprise swab cups 78 or other sealing elements coupled with the nose 74.

Figure 12:
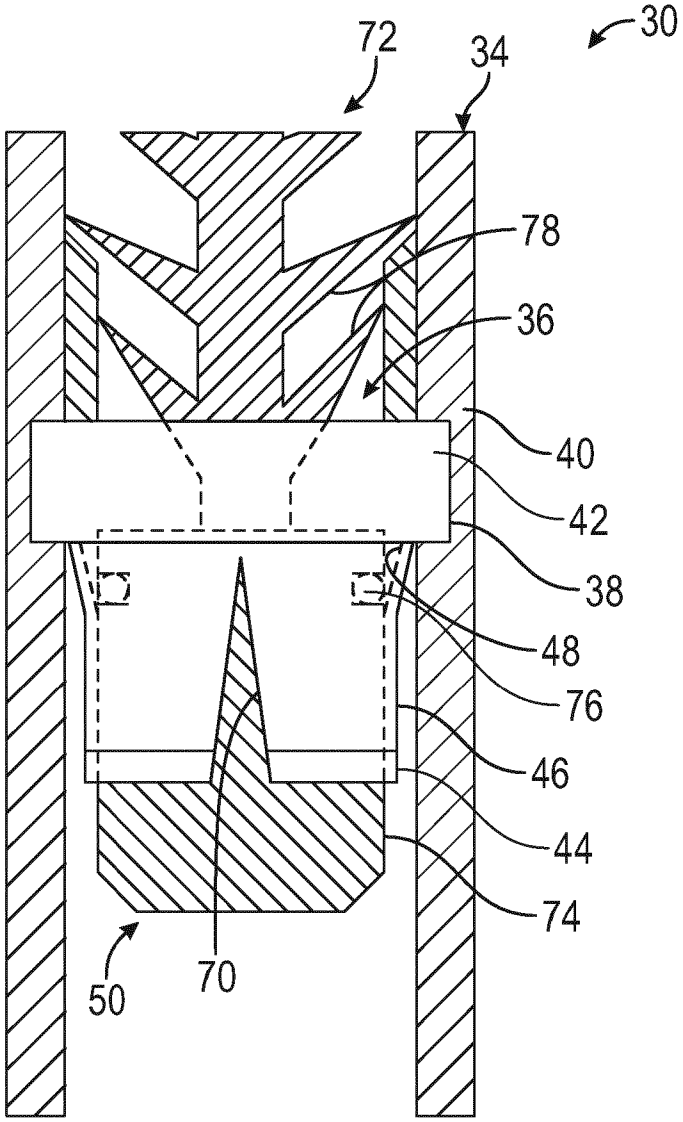
FIG. 12 is a schematic illustration similar to that of FIG. 11 but showing the element moving through the extrudable ball seat upon further crack propagation, according to an embodiment of the disclosure.
Figure 13:
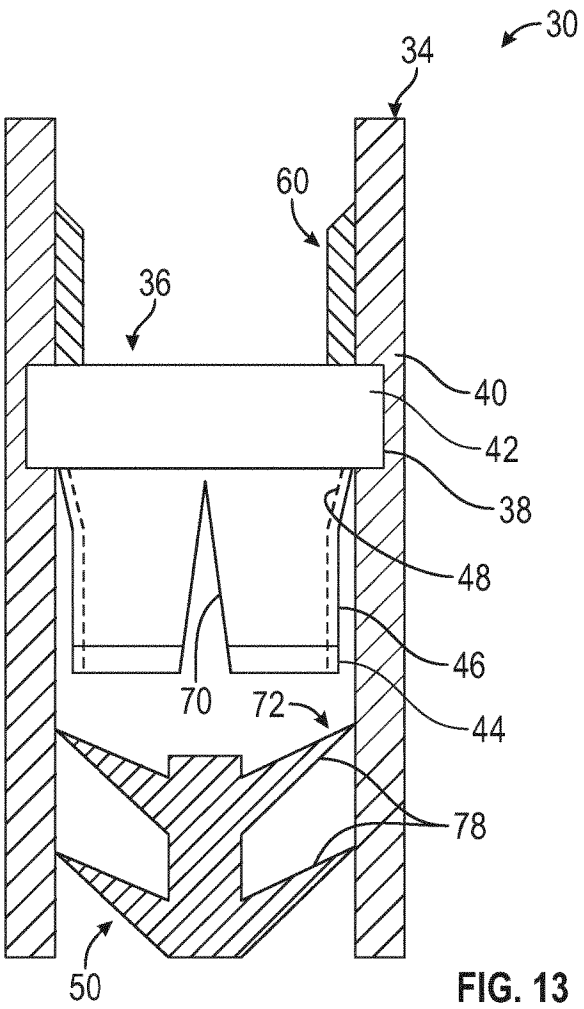
FIG. 13 is a schematic illustration similar to that of FIG. 12 but showing the element fully extruded through the extrudable ball seat, according to an embodiment of the disclosure.

Once sealed, pressure may be increased above the dart 72 (or other tool) to move the dart downwardly and to plastically deform the extrudable ball seat 36, thus initiating or causing further propagation of the crack(s) 70 as illustrated in FIG. 12. If the cracks 70 have already been initiated, e.g. initiated during passage of second ball 64, the pressure used to expel the dart 72 (or other tool) through the expandable ball seat 36 is substantially reduced compared to what would otherwise be applied. As a result, the dart/tool 72 is readily extruded through and expelled from the extrudable ball seat 36, as illustrated in FIG. 13.

Figure 14:
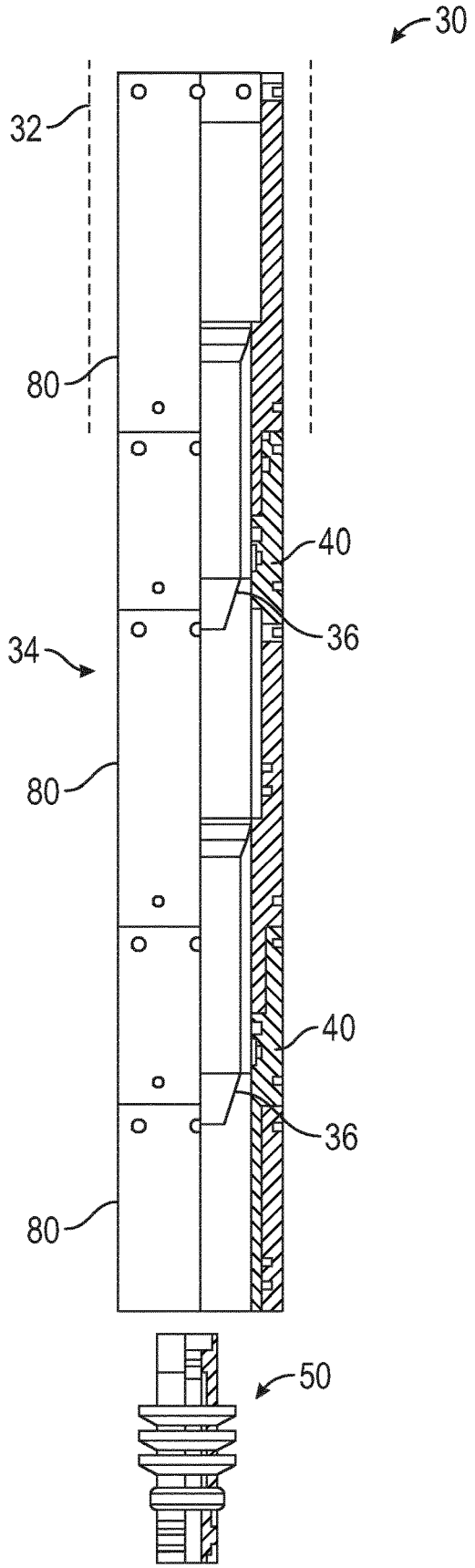
FIG. 14 is a schematic illustration of another embodiment of a well system having a plurality of extrudable ball seats, according to an embodiment of the disclosure.

Depending on the parameters of a given operation, additional extrudable ball seats 36 may be employed along tubing joints 80 forming overall well tubing 34, as illustrated in FIG. 14. By way of example, a pair of the extrudable ball seats 36 may be positioned along well tubing 34 and may have different sizes. By using controlled expansion and controlled initiation of cracking at each extrudable ball seat 36, as described above, multiple hydraulic actuation functions may be performed downhole by using the plurality of extrudable ball seats 36.

It should be noted the extrudable ball seats 36 may be used in many types of applications and along various types of well tubing 34. For example, at least one extrudable ball seat 36 may be used along well tubing 34 assembled in the form of a liner hanger running tool to facilitate hydraulic setting of a liner hanger. The size and configuration of the extrudable ball seat 36 may be adjusted according to the application. For example, the configuration of the larger diameter section 42, smaller diameter section 44, and conical section 46 may be adjusted. The conical section 46 may have a variety of external configurations while retaining the conical internal seating surface 48. Additionally, the extrudable ball seat 36 may be used with various types of polished bore receptacles 60 and/or other cooperating components.

The elements 50 may be in the form of balls or other types of tools. Additionally, the balls 52, 64 may have various shapes including fully spherical shapes, partially spherical shapes, or other suitable shapes able to form a seal with the corresponding sealing seat surface 48.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well tubing disposed in a borehole; and an extrudable ball seat secured along the well tubing, the extrudable ball seat comprising:

a larger diameter section;

a smaller diameter section; and a conical section extending between the larger diameter section and the smaller diameter section, the conical section having an internal ball seat surface for receiving a plurality of different balls in sealing engagement, the smaller diameter section being formed of a material which expands to extrude a first ball of a first diameter under pressure, the smaller diameter section further comprising at least one notch located to initiate crack propagation when a second ball of a second diameter, larger than the first diameter and of at least a pre-set value, is extruded through the smaller diameter section when placed under pressure;

a polished bore receptacle positioned directly uphole of the extrudable ball seat for receiving a dart;

wherein the dart is sealed against an interior surface of the polished bore receptacle; and wherein the dart is extruded through the smaller diameter section under pressure.

2. The system as recited in claim 1, wherein the smaller diameter section and the conical section are formed of a steel material.

3. The system as recited in claim 1, wherein the smaller diameter section and the conical section are formed of a stainless steel material.

4. The system as recited in claim 1, wherein the at least one notch comprises a plurality of grooves.

5. The system as recited in claim 1, wherein the smaller diameter section is in the shape of a cylinder.

6. The system as recited in claim 5, wherein the at least one notch comprises a plurality of grooves oriented in a generally axial direction along the cylinder.

7. The system as recited in claim 1, wherein the smaller diameter section and the conical section are constructed to enable extrusion of the first ball without initiating crack propagation when a predetermined pressure above 2000 psi is applied in the well tubing.

8. The system as recited in claim 1, wherein the smaller diameter section and the conical section are constructed to enable extrusion of the first ball without initiating crack propagation when a predetermined pressure above 3000 psi is applied in the well tubing.

9. A method, comprising:

providing an extrudable ball seat with a larger diameter section, a smaller diameter section, and a conical section extending between the larger diameter section and the smaller diameter section; and positioning at least one notch along the extrudable ball seat to enable initiation of crack propagation in the extrudable ball seat upon extrusion of an element through the extrudable ball seat when the element has a diameter of at least a pre-set value; wherein the element is a first ball or second ball; and locating a polished bore receptacle positioned directly uphole of the extrudable ball seat for sealingly receiving a dart and wherein the dart is sealed against an interior surface of the polished bore receptacle.

10. The method as recited in claim 9, further comprising locating the extrudable ball seat along a well tubing disposed in a borehole.

11. The method as recited in claim 10, further comprising moving the first ball down along an interior of the well tubing until seated against the conical section to enable an increased pressure of a first value to be applied in the well tubing.

12. The method as recited in claim 11, further comprising applying a pressure in the well tubing at a second value, higher than the first value, until the first ball is extruded through the extrudable ball seat without initiating crack propagation from the at least one notch.

13. The method as recited in claim 12, further comprising moving the second ball down along the interior of the well tubing until seated against the conical section, the second ball having a larger diameter than the first ball; and applying pressure until crack propagation is initiated at the at least one notch and the second ball is extruded through the extrudable ball seat.

14. The method as recited in claim 9, further comprising forming the at least one notch as a plurality of grooves located in the smaller diameter section.

15. The method as recited in claim 9, comprising pumping the dart down into the polished bore receptacle creating the seal; and subsequently extruding the dart through the extrudable ball seat.

16. A system, comprising:

an extrudable ball seat having a larger diameter section, a smaller diameter section, and a conical section extending between the larger diameter section and the smaller diameter section, the conical section being formed by an internal ball seat surface for receiving a plurality of different elements in sealing engagement, the smaller diameter section comprising at least one notch located to initiate crack propagation when an element having a diameter of at least a pre-set value is extruded through the smaller diameter section when placed under pressure;

a polished bore receptacle positioned directly uphole of the extrudable ball seat for receiving a dart;

wherein the dart is sealed against an interior surface of the polished bore receptacle; and wherein the dart is extruded through the smaller diameter section under pressure.

17. The system as recited in claim 16, wherein the larger diameter section and the smaller diameter section are each formed as a cylindrical section.

18. The system as recited in claim 16, wherein the at least one notch comprises a plurality of longitudinally oriented grooves.

* * * * *